United States Patent [19]

Kojima et al.

[11] 4,275,148

[45] Jun. 23, 1981

[54] LIGHT-SENSITIVE SILVER HALIDE COLOR PHOTOGRAPHIC MATERIALS

[75] Inventors: Tamotsu Kojima; Mitsuto Fujiwhara; Takaya Endo; Akio Iijima, all of Hino, Japan

[73] Assignee: Konishiroku Photo Industry Co., Ltd., Tokyo, Japan

[21] Appl. No.: 964,283

[22] Filed: Nov. 28, 1978

[30] Foreign Application Priority Data

Dec. 9, 1977 [JP] Japan ..... 52-148525

[51] Int. Cl.[3] ..... G03C 1/40

[52] U.S. Cl. ..... 430/558; 430/386; 430/387

[58] Field of Search ..... 96/56.5, 100 R; 430/558

[56] References Cited

U.S. PATENT DOCUMENTS

| | | | |
|---|---|---|---|
| T887,007 | 6/1971 | Dallon et al. | 430/548 |
| 2,436,130 | 2/1948 | Weissberger et al. | 96/100 R |
| 2,575,182 | 11/1951 | Martin | 96/56.5 |
| 2,706,685 | 4/1955 | Salminen | 96/56.5 |
| 4,123,281 | 10/1978 | Monbaliu et al. | 96/100 R |

*Primary Examiner*—J. Travis Brown

*Attorney, Agent, or Firm*—Frishauf, Holtz, Goodman & Woodward

[57] ABSTRACT

A color photographic material comprising a light-sensitive silver halide emulsion layer coated on a support containing a magenta coupler represented by general formual [I] or [II]:

[I],

[II]

wherein, $R_1$ represents a hydrogen atom, an alkyl, aryl or 5 or 6-membered heterocyclic group, $R_2$ represents a hydrogen atom, an alkyl, aryl, 5 or 6-membered heterocyclic, amino, sulfamoyl or carbamoyl group, $R_3$ represents an alkyl, aryl or 5 or 6-membered heterocyclic group having from 12 to 35 carbon atoms, $R_4$ represents an alkyl group having from 2 to 8 carbon atoms or a phenyl group, and $R_5$ represents an alkyl group having from 2 to 8 carbon atoms.

6 Claims, No Drawings

LIGHT-SENSITIVE SILVER HALIDE COLOR PHOTOGRAPHIC MATERIALS

The invention relates to light-sensitive color photographic materials capable of forming dye images having superior photographic capabilities. More particularly, it relates to inner light-sensitive silver halide color photographic materials capable of forming color images having various advantages, such as high color properties, less fog, superior color purity, quite less decrease in developed color density after a prolonged storage and remarkable graininess, by incorporating an active point substitution type (i.e. two equivalents type) magenta coupler into a light-sensitive silver halide photographic material.

In photographic techniques, silver halides are often used as the light-sensitive ingredient, for the purpose of recording of light information, because of their excellent photographic characteristics, such as sensitivity and gradation.

A dye image may be obtained by the reaction of the coloring compound with a species of a reactive compound to form a dye, corresponding to the information recorded on the silver halide. The coloring compound, or coupler, is employed to form a dye together with a reactive compound which is generally a color developing agent like an aromatic primary amine developing agent.

A coupler having hydrogen atom at the active point is called "four equivalents type coupler", and a coupler having a so-called split-off group capable of releasing itself readily in a reaction with a color developing agent at the active point is called "two equivalents type coupler". The four equivalents or two equivalents type of coupler requires silver halides having four or two equivalents of the center of development per active point, respectively, and therefore, the two equivalents type coupler gives a denser dye image than the four equivalents type coupler when the same amounts of developed silver are present. Further, with regard to the two equivalents type coupler, it is possible to give a compound formed by elimination of the split-off group the development-inhibiting activity, by optionally selecting a linking group of the split-off group to be linked with the active point. For instance, a two equivalents type coupler having a split-off group, the linking group of which is a thio group (—S—) is called "development" inhibitor-releasing coupler (DIR coupler)" and serves the purpose of various applications because it inhibits the development proportionally to the amount of the developed silver. For example, by using the DIR coupler, there may be obtained so-called "intra image effects" such as control of the image contrast and fining of image particles within the layer, and at the same time, so-called "inter image effects" such as improvement in color, acting into other layers. The DIR coupler, therefore, may also be applied to the diffusion transfer process.

However, in spite of the advantages of the two equivalents type coupler over the four equivalents type coupler, the two equivalents type coupler has disadvantages to be overcome that it tends to give the light-sensitive layer comprising a silver halide fog and color strain and that it may not be dispersed into the light-sensitive layer with a sufficient dispersion concentration. The two equivalents type couplers are disclosed in U.S. Pat. No. 3,227,554 and Japanese Patent Publication Specifications Nos. 50-122935, 51-10935, 51-13239 and 51-14023, as laid open to public inspection. Although there may be obtained superior color sensitivity and maximum color concentration by using the above-mentioned couplers, there may be hardly obtained light-sensitive materials in which these characteristics are markedly improved by using the above-mentioned couplers in large quantities, because they are the DIR couplers.

The tendency is marked when the active point-substituting constituent, i.e. development-inhibiting constituent has a low molecular weight. It is known, e.g. in Japanese Patent Publication Specification No. 50-122935, as laid open to public inspection, that when the active point-substituting constituent has sufficiently large molecular weight and when the diffusion within the emulsion layer is substantially impossible, the development-inhibiting activity of the coupler of such natures is substantially diminished, and therefore, the marked improvement in the light sensitivity and the maximum color density may be achieved by using the coupler in large quantities. However, the coupler of such natures has disadvantages yet to be improved that it is unstable itself, that, i.a. the magenta coupler quite tends to cause yellow stain the improvement of which is particularly desired, and that it has an insufficient stability against formalin. Further, the colored dye image is remarkably faded by the interaction with the unstable coupler.

It has, therefore, been desired to improve the above-mentioned disadvantages much more.

It is an object of the invention to provide light-sensitive silver halide color photographic materials which can form desirable dye images by using a novel two equivalents type coupler having superior photographic characteristics and having no above-mentioned disadvantages.

It is another object of the invention to provide light-sensitive silver halide color photographic materials which show a very good color properties and no desensitizing property with less fog and color stain, and have good light stability and graininess of the colored dye.

It is still another object of the invention to provide light-sensitive silver halide color photographic materials, the coupler of which shows superior solubilizing and dispersing properties into a high boiling point solvent stably, and therefore, gives superior coloring properties, transparency and color purity.

The above-mentioned and hereinafter-mentioned objects of the invention may be attained by incorporating a compound represented by the general formulae [I] or [II] (hereinafter referred to as compound of the invention) into a silver halide emulsion layer of the light-sensitive silver halide color photographic material:

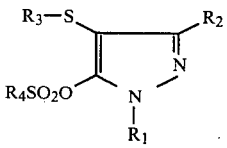

[I]

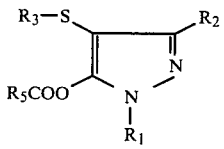

[II]

(wherein $R_1$ represents a hydrogen atom or an alkyl, aryl or a 5 or 6-membered heterocyclic group; $R_2$ represents hydrogen atom, an alkyl, aryl, a 5 or 6-membered heterocyclic, amino, sulfamoyl or carbamoyl group; $R_3$ represents an alkyl, aryl or a 5 or 6-membered heterocyclic group having from 12 to 35 carbon atoms including a substituent or substituents; $R_4$ represents an alkyl group having from 2 to 8 carbon atoms or a phenyl group; and $R_5$ represents an alkyl group having from 2 to 8 carbon atoms.).

More specifically, in formulae [I] and [II], the alkyl group of $R_1$ may be preferably an alkyl group having from 1 to 22 carbon atoms which may optionally have substituent. Preferable examples of the unsubstituted alkyl group are methyl, ethyl, t-butyl, octyl and dodecyl; and preferable examples of substituted alkyl group are an alkyl substituted with halogen, such as 2-chlorobutyl and ω-bromoctyl, an alkyl substituted with hydroxy, such as 3-hydroxyheptyl and ω-hydroxydecyl and an alkyl substituted with phenyl, such as 2-phenylpropyl and 2-(2,4,6-trichlorophenyl)ethyl. The aryl group of $R_1$ is preferably a phenyl group which may optionally include the substituted, such as a phenyl group, a phenyl substituted with halogen, such as 2,4,6-trichlorophenyl and 2,4,6-trifluorophenyl, a phenyl substituted with halogen and alkyl, such as 2,4-dimethyl-6-chlorophenyl, a phenyl substituted with halogen and alkoxy, such as 2,6-dichloro-4-methoxyphenyl, and a phenyl substituted with halogen, ester, acylamido, alkyl and/or alkoxy, such as 2,6-dichloro-4-dodecanamido-phenyl, 2,6-dichloro-4-tetradecyloxycarbonylphenyl, 2-methoxy-4-propoxycarbonylphenyl and 4-tetradecanamidophenyl.

More preferably, $R_1$ is an aryl group of above mentioned groups.

Preferably the heterocyclic group of $R_1$ contain a nitrogen, oxygen or sulfur atom, whose examples are benzothiazolyl, benzoxazolyl, benzimidazolyl, picolyl and piperidinyl which may optionally be substituted. More concretely, they may be benzothiazolyl, 6-chlorobenzothiazolyl, benzoxazolyl, 5-pentanamidobenzoxazolyl and 6-methoxybenzimidazolyl.

In formulae [I] and [II], the alkyl group, the aryl group and the heterocyclic group represented by $R_2$ have the same meanings as those defined under $R_1$.

The amino group of $R_2$ may be substituted and examples of which group are preferably an amino, carbonamide, sulfonamide, ureide, amino substituted with alkyl, such as methylamino, dodecylamino and N-ethyl-N-hexylamino, and amino substituted with phenyl, such as phenylamino, 2-chloro-5-dodecanamidophenylamino, 2-trifluoromethyl-5-tetradecylcarbamoylphenylamino, 2,4-dichlorophenylamino, N,N-diphenylamino and N-ethyl-N-tolylamino.

Preferable examples of the carbonamido group are an alkylcarbonamido, such as ethylcarbonamido, dodecylcarbonamido and phenethylcarbonamido, and an arylcarbonamido, such as phenylcarbonamido, 2,4,6-trichlorophenylcarbonamido, 3-[α-(2,4-di-t-amylphenoxy)acetamido]benzamido and 3-dodecylsuccinimidobenzamido.

Preferable examples of the sulfonamido group are an alkylsulfonamido, such as butylsulfonamido, tetradecylsulfonamido and phenethylsulfonamido, and an arylsulfonamido, such as phenylsulfonamido, 4-dodecylphenylsulfonamido and 4-tetradecanamidophenylsulfonamido.

Preferably examples of the sulfamoyl group are an alkylsulfamoyl, such as propylsulfamoyl, pentadecylsulfamoyl, 2-ethylhexylsulfamoyl and2,4-di-t-amylphenoxybutylsulfamoyl, and an arylsulfamoyl, such as phenylsulfamoyl, 2,4-dichlorophenylsulfamoyl and N-ethyl-N-phenylsulfamoyl.

Preferable examples of the carbamoyl group are an alkylcarbamoyl, such as ethylcarbamoyl, 2-hydroxyethylcarbamoyl, dodecylcarbamoyl and N-ethyl-N-decylcarbamoyl, and an arylcarbamoyl, such as phenylcarbamoyl, 3-tetradecylcarbamoylphenylcarbamoyl.

Preferable examples of the ureido group are an alkylureido such as hexylureido, tetradecylureido and benzylureido, and an arylureido, such as phenylureido, N-dodecyl-N-phenylureido and 3-pentadecylphenylureido.

In formulae [I] and [II], the alkyl, aryl and heterocyclic group represented by $R_3$ have the same meanings as those defined under $R_1$ but having from 12 to 35 carbon atoms.

In formula [I[, the phenyl group represented by $R_4$ has the same meaning as that defined under $R_1$; but it preferably has no substituent.

Further, preferable examples of the alkyl group having from 2 to 8 carbon atoms represented by $R_4$ and $R_5$ are primary or secondary alkyl groups e.g. ethyl, n-propyl and n-butyl; isopropyl and sec-butyl.

The magenta coupler compounds of the invention may be bis-compounds linked via group $R_3$.

The following is a non-limiting list of the group $R_3$—S— of formulae [I] and [II], namely representative thio groups having a hydrophobic, diffusion-preventing group, and having from 12 to 35 carbon atoms substituted at 4-position of the pyrazole ring.

Examples of group —S—$R_3$:

—S—$C_{12}H_{25}$(n)
—S—$C_{14}H_{29}$(sec)
—S—$C_2H_4C_{12}H_{25}$(n)
—S—$C_{18}H_{35}$(Δ1-2)

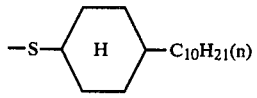

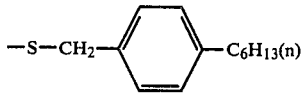

—S—$C_3H_6CONHC_{12}H_{25}$(n)

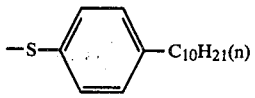

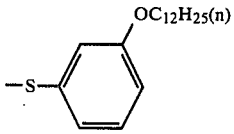

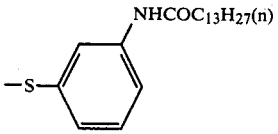

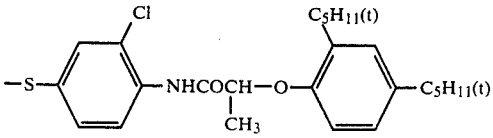

-continued
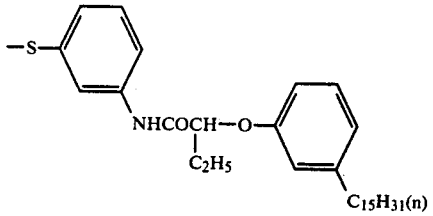
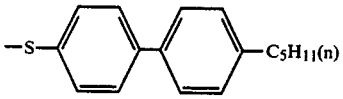
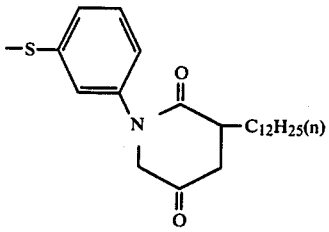
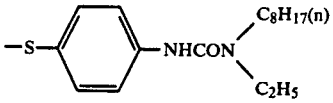
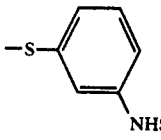
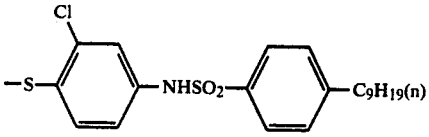
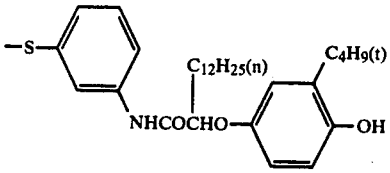
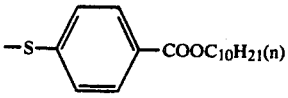
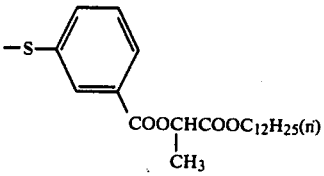
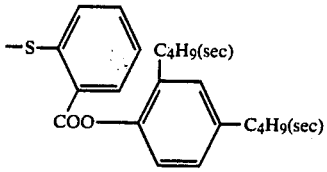
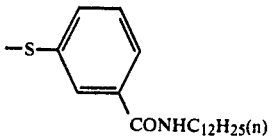
-continued
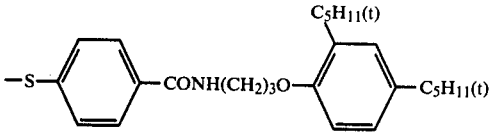
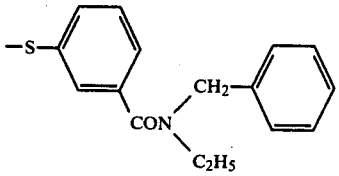
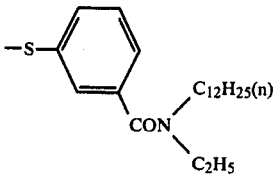
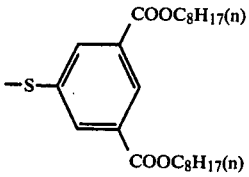
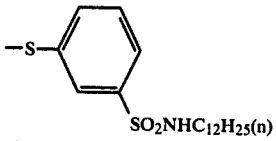
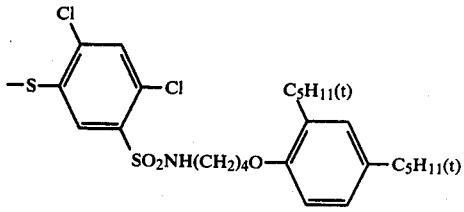
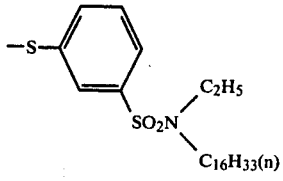
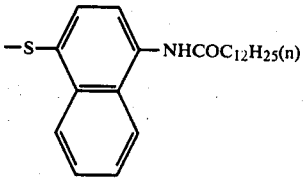
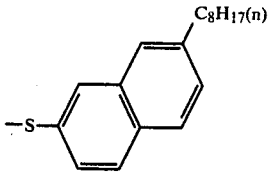

-continued

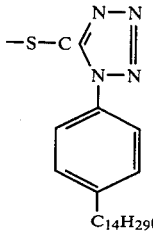

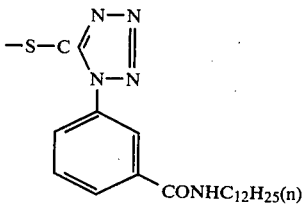

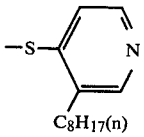

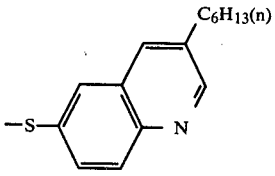

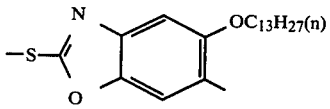

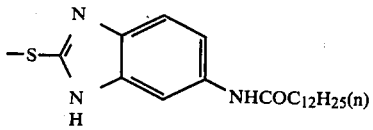

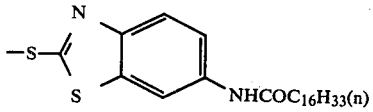

-continued

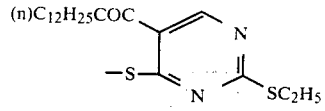

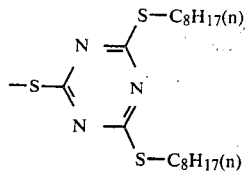

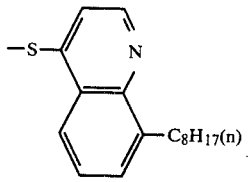

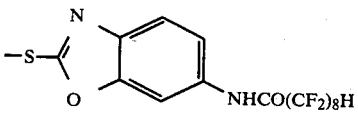

The light-sensitive silver halide color photographic materials of the invention comprising the compound of the invention may exhibit various effects, such as high color properties, very few fog and color stain, superior color purity, very few degradation of color density upon prolonged storage and no color trouble with a gas like formalin, as compared with similar kind of light-sensitive materials comprising known pyrazolone derivatives having a monothio substituent at 4-position.

Further, by incorporating the compound of the invention into light-sensitive silver halide photographic material, the light-sensitive layer may be prepared thinner; the resolving power and sharpeness of the dye image may be improved; and particularly in multiple layers light-sensitive photographic materials, the photographic sensitivity may be improved because of improvement of light transparency toward lower layers.

Representative examples of the compound of the invention may be illustrated below, which by no means restrict the scope of the invention.

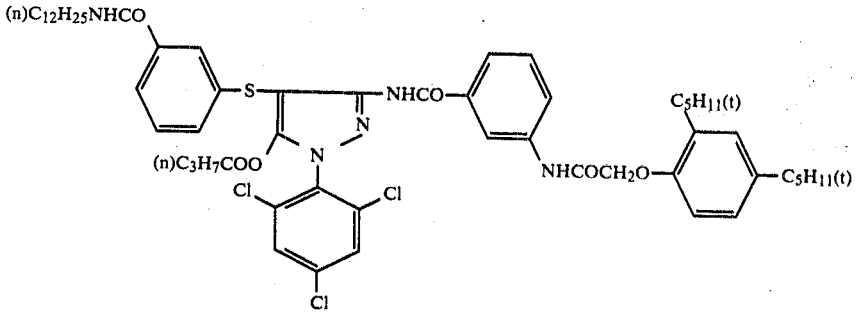

(1)

-continued
(2)
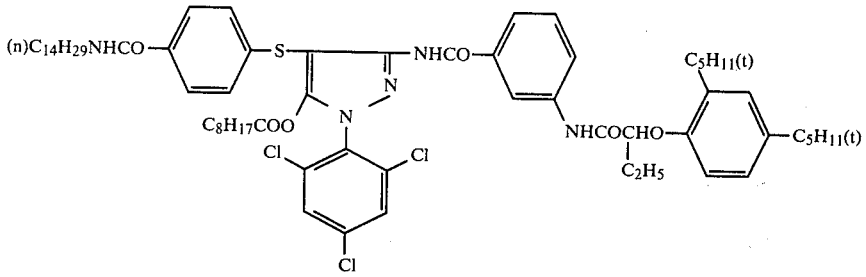
(3)
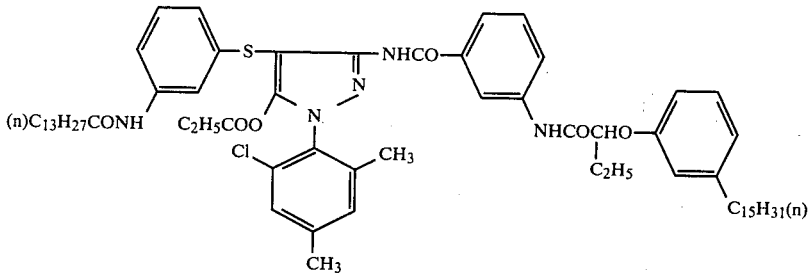
(4)
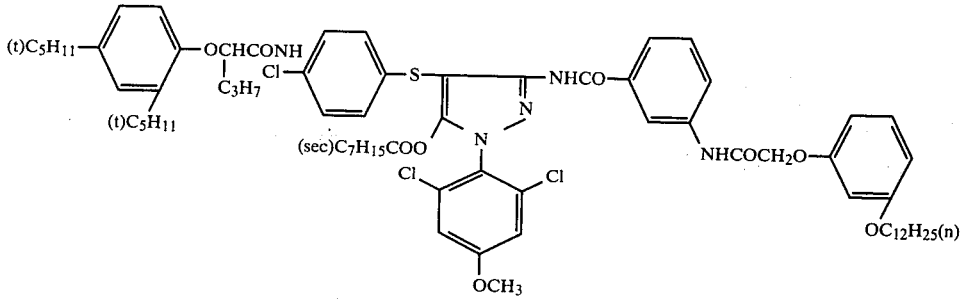
(5)
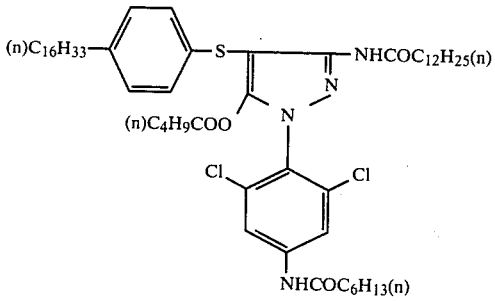
(6)
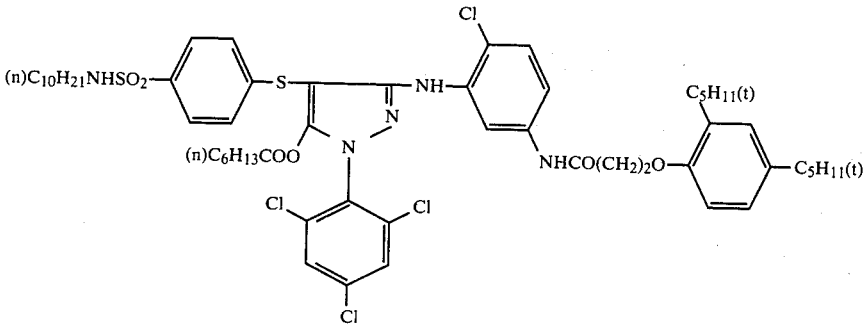

-continued
(7)
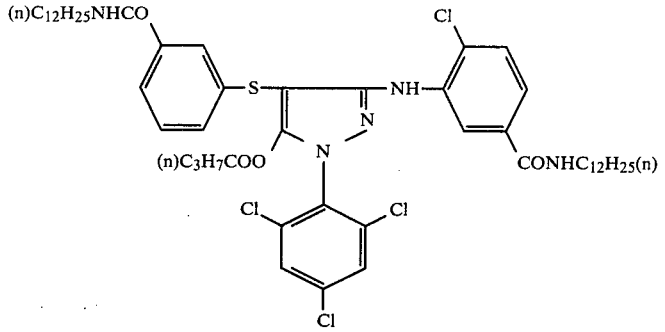
(8)
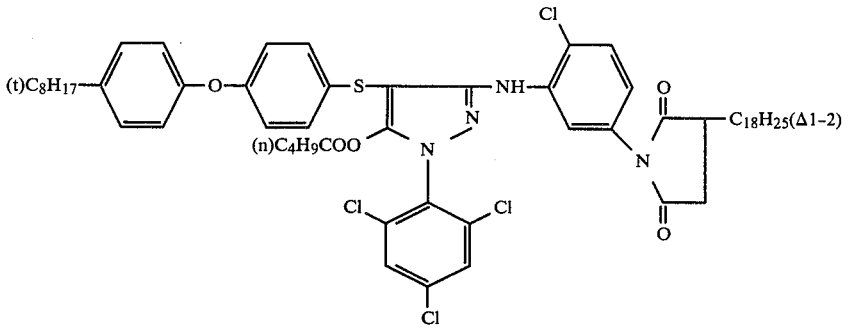
(9)
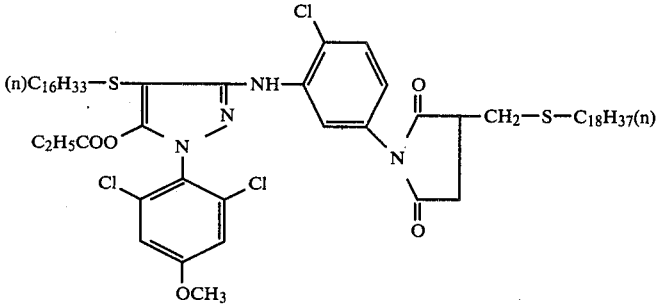
(10)
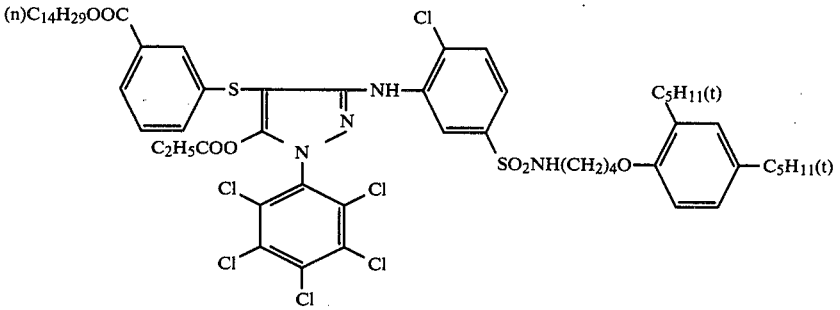
(11)
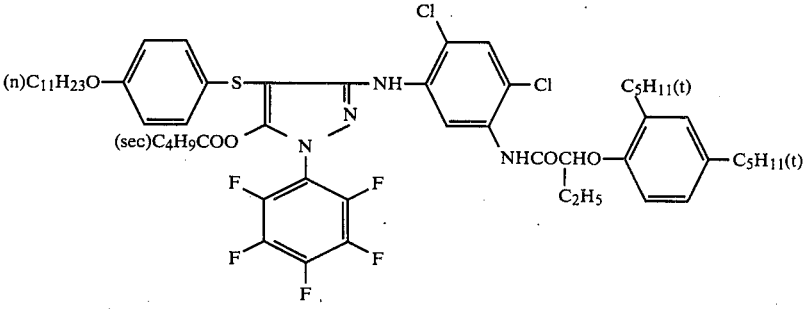

-continued
(12)
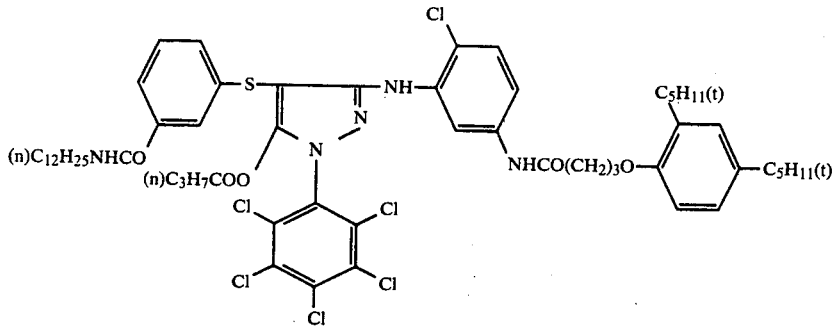
(13)
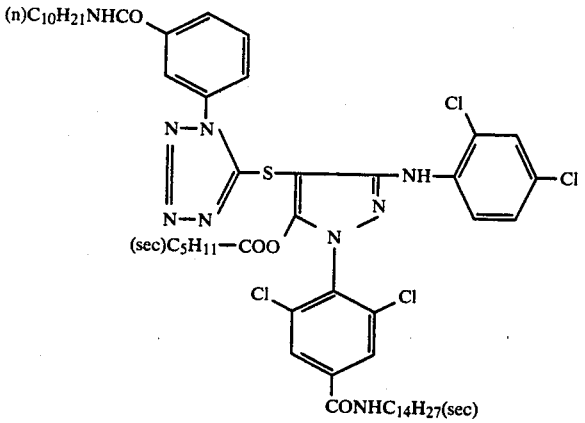
(14)
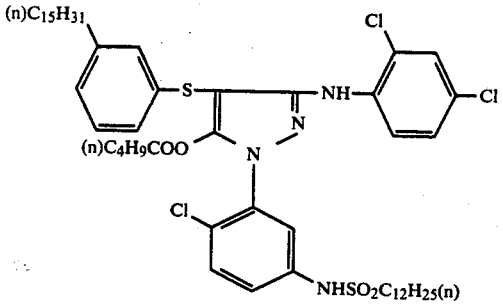
(15)
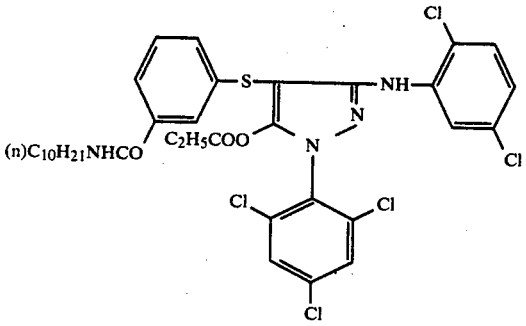
(16)
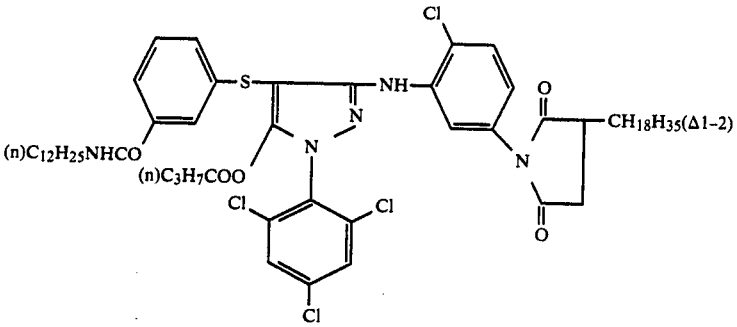

-continued
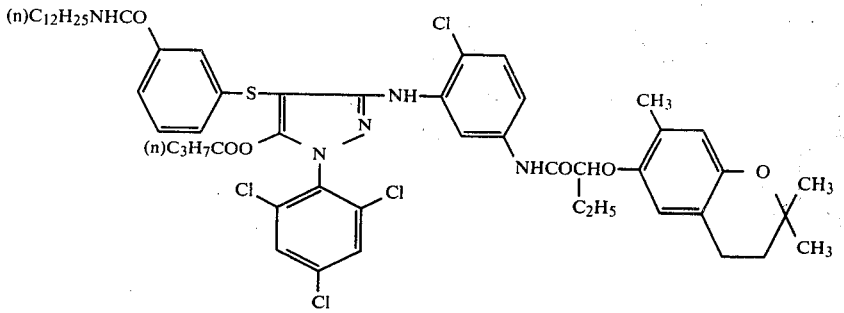
(17)
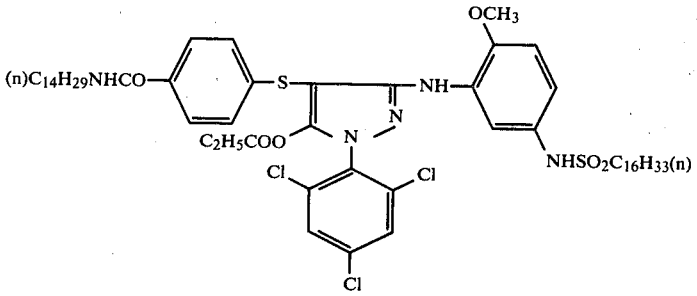
(18)
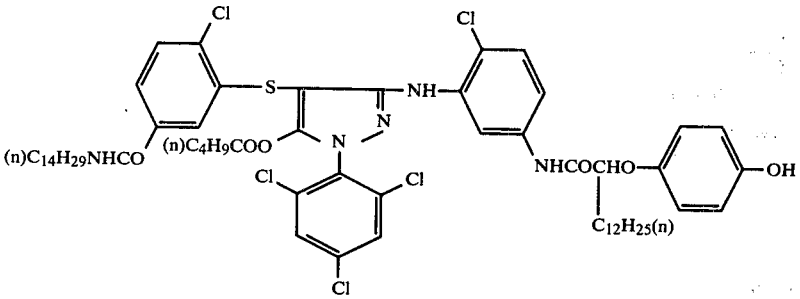
(19)
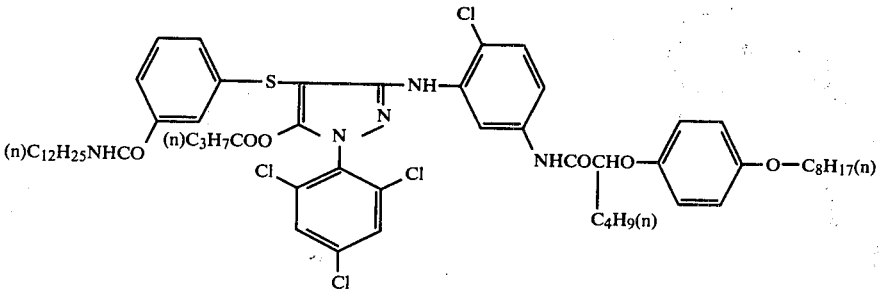
(20)
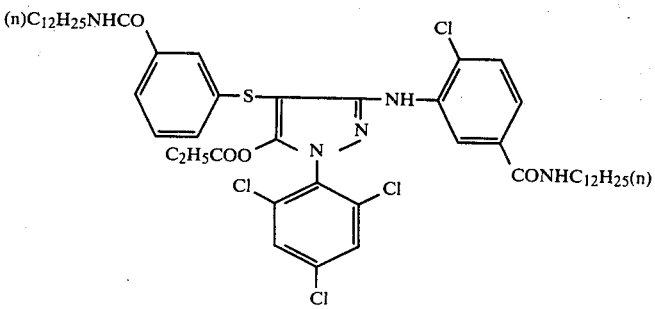
(21)

-continued
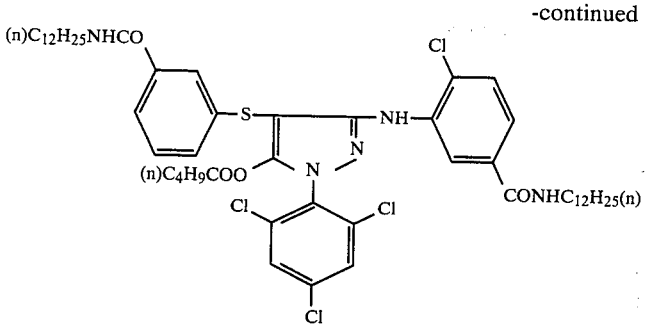
(22)
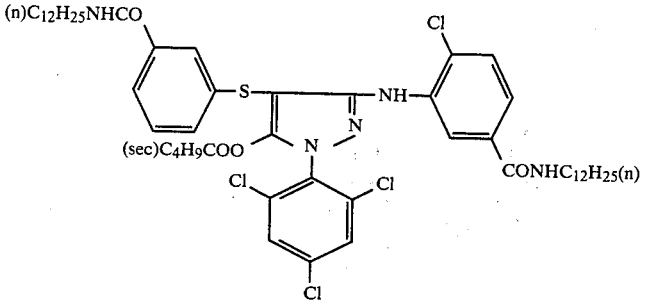
(23)
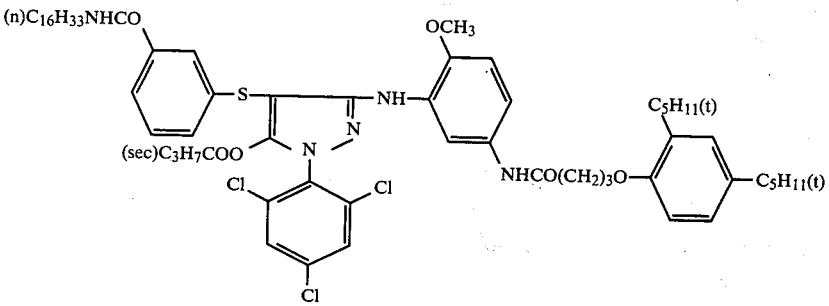
(24)
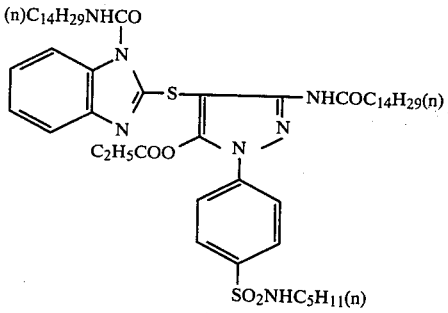
(25)
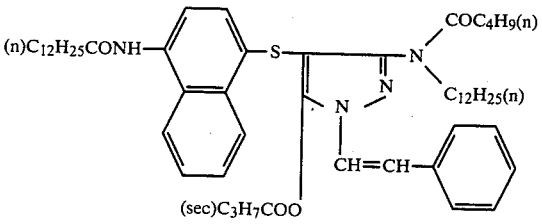
(26)
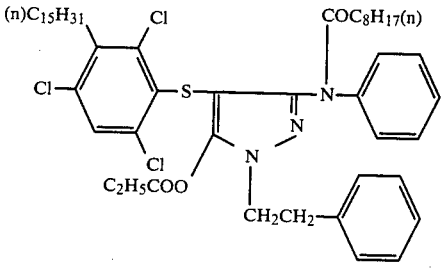
(27)

-continued
(28)
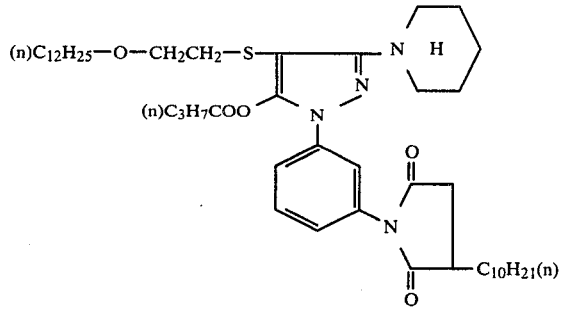
(29)
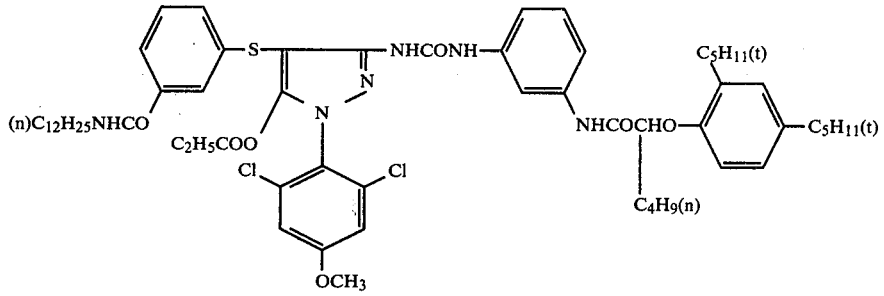
(30)
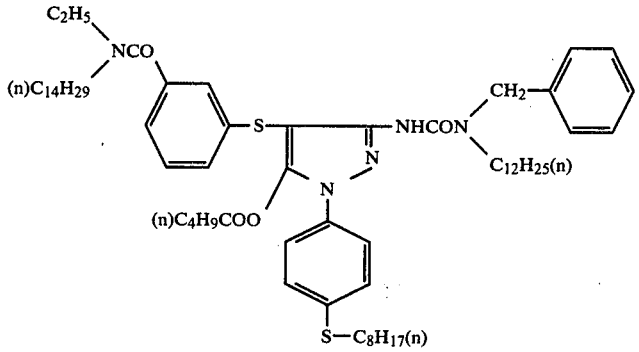
(31)
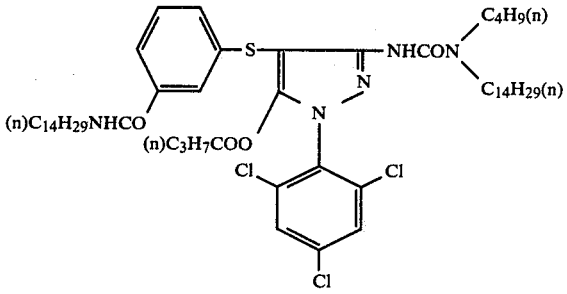
(32)
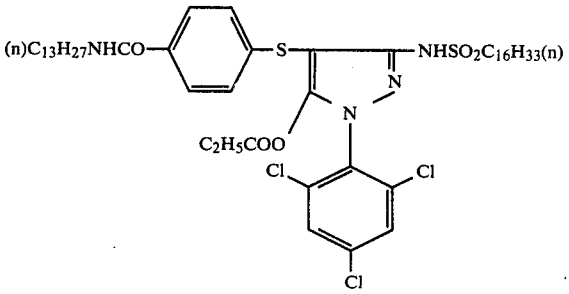

-continued
(33)
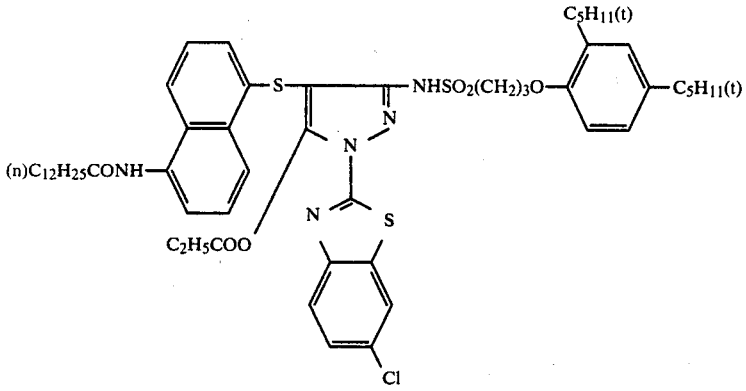
(34)
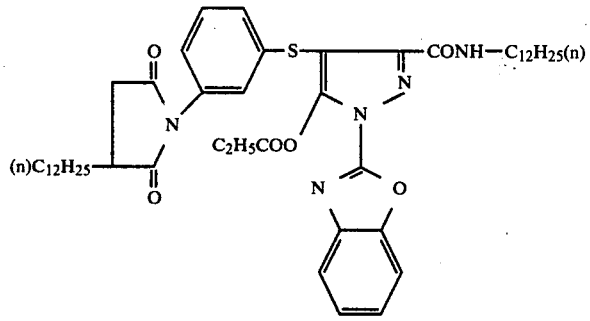
(35)
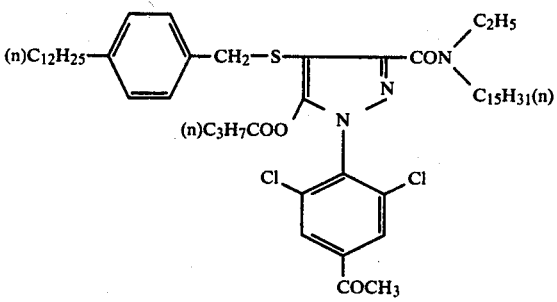
(36)
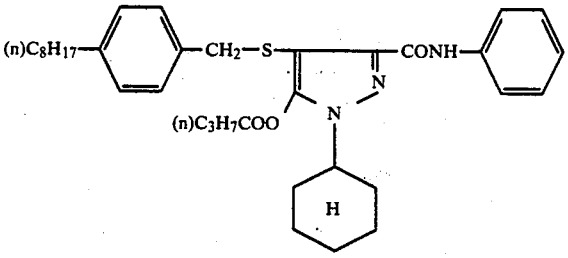
(37)
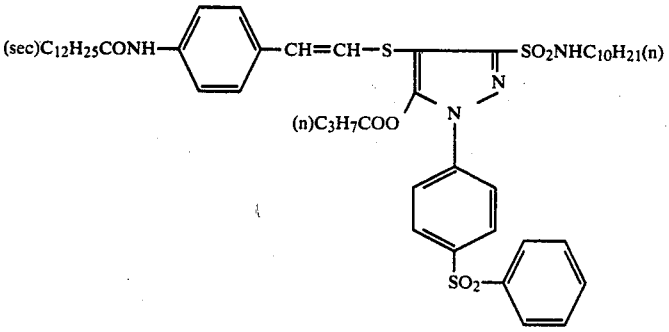

-continued
(38)
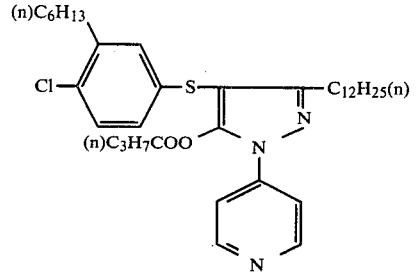
(39)
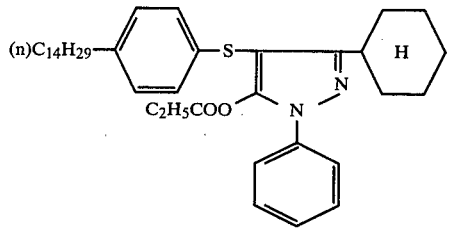
(40)
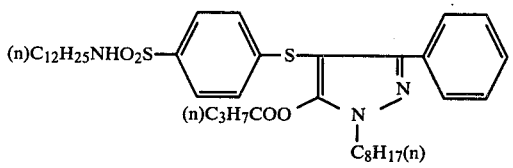
(41)
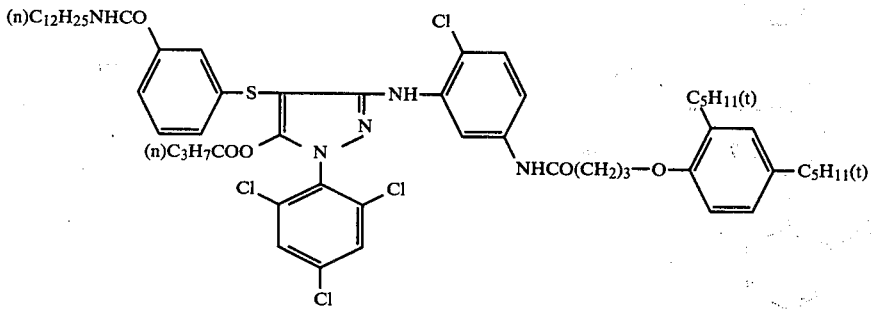
(42)
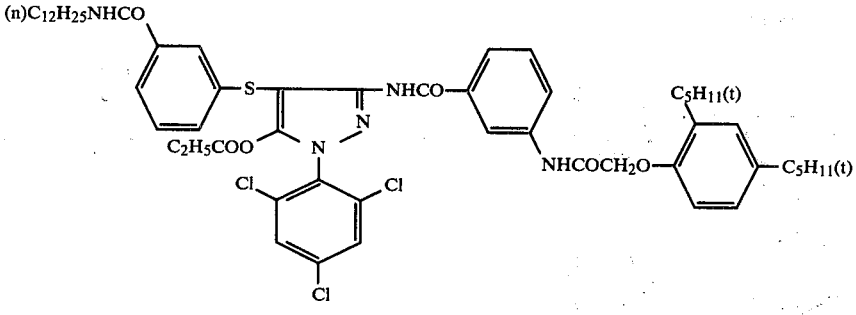
(43)
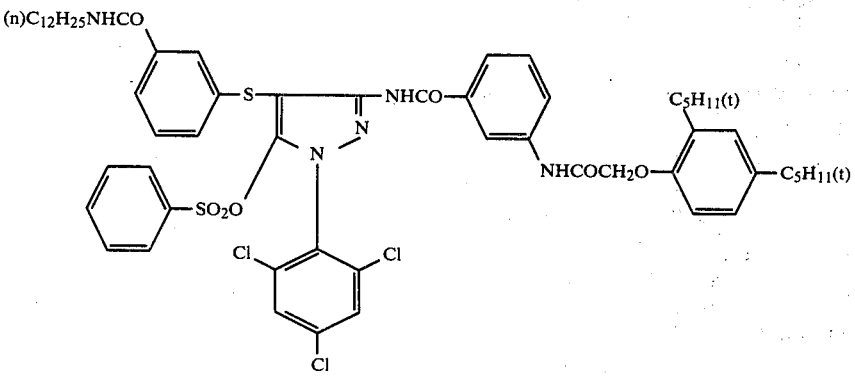

-continued
(44)
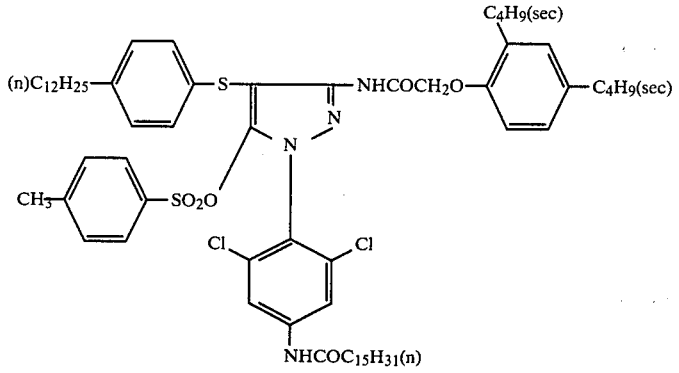
(45)
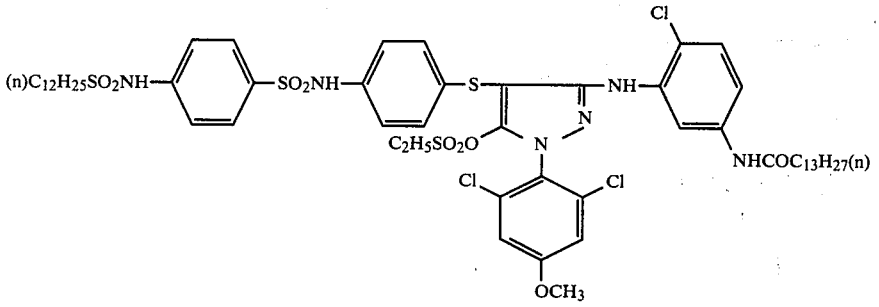
(46)
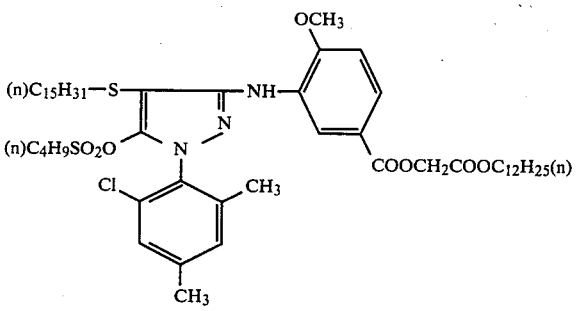
(47)
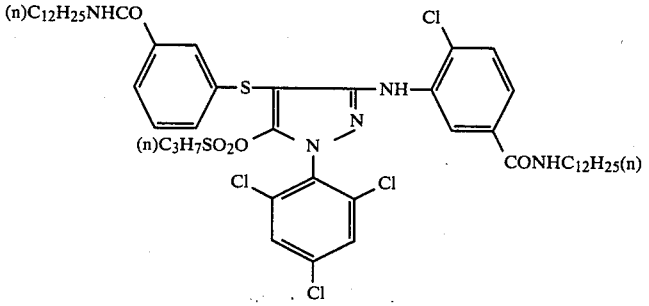
(48)
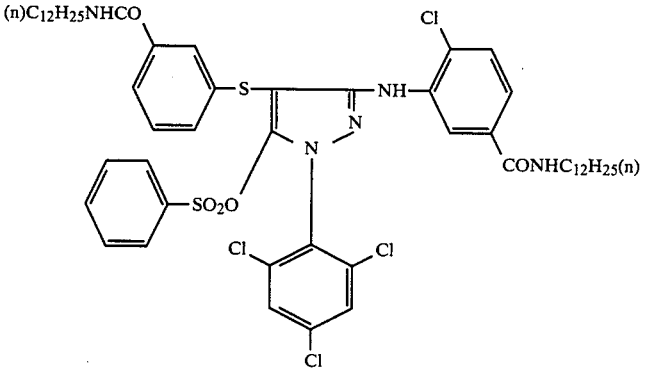

-continued
(49)
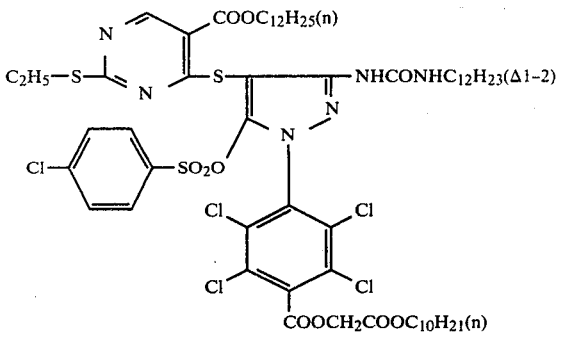
(50)
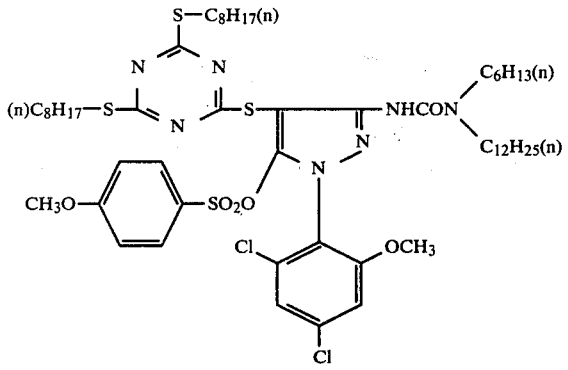
(51)
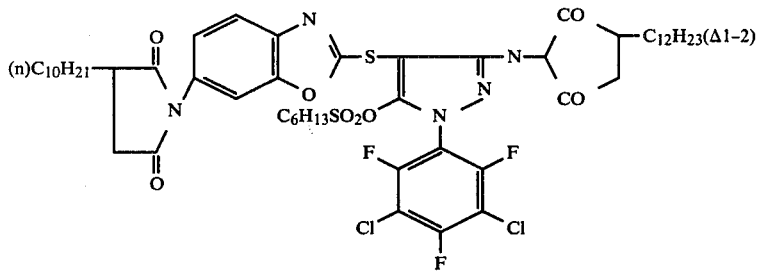
(52)
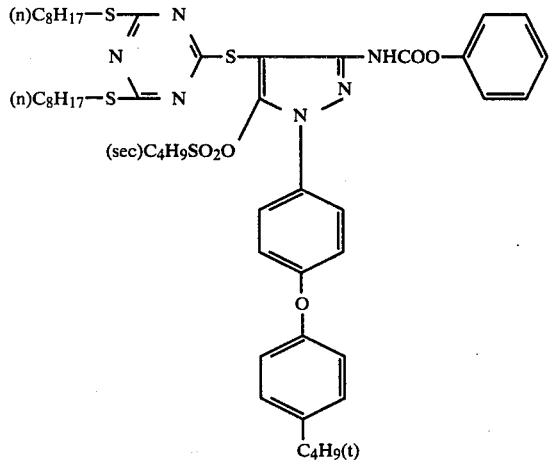
(53)
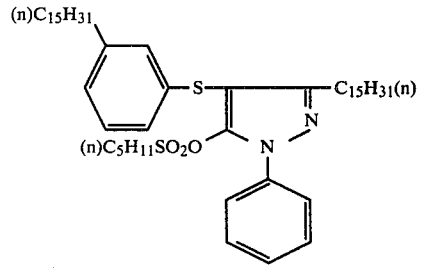

-continued (54)

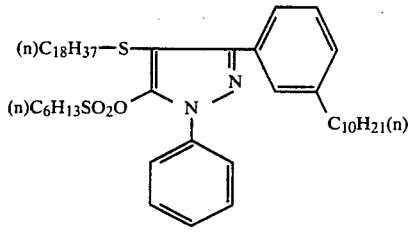

The compounds of the invention may be prepared by reacting 4-substituted-5-pyrazolone represented by the following formula [III]

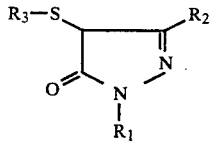

(wherein, $R_1$, $R_2$ and $R_3$ have the meanings defined under general formula [I] or [II]) with the corresponding acid halide or acid anhydride in the presence of a suitable solvent, such as toluene, xylene, benzene, dioxane, tetrahydrofuran, diethyl ether, acetonitrile, ethyl acetate, chloroform, carbon tetrachloride, dimethylformamide, dimethyl sulfoxide or pyridine.

The starting compounds of formula [III] may be prepared by the method disclosed in U.S. Pat. No. 3,227,554.

Preparations of the corresponding acid halides and acid anhydrides are well known, and some of them are commercially available.

Alternatively, the compounds of the invention may also be prepared by reacting a 5-substituted pyrazole represented by formula [IV] or [V]

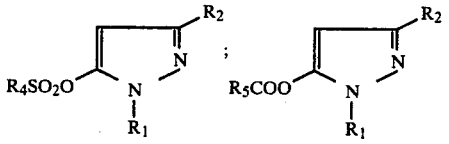

[IV] [V]

(wherein, $R_1$, $R_2$, $R_4$ and $R_5$ have the meanings defined under formula [I] or [III]) with the corresponding reagent.

Preparations of representative compounds according to the invention will be given below.

PREPARATION 1

1-(2,4,6-trichlorophenyl)-3-(2-chloro-5-dodecylcarbamoylanilino)-4-(3-dodecylcarbamoylphenylthio)-5-butyryloxypyrazole (Illustrated compound No. 7)

Into a mixture of 32 g. of bis(3-N-dodecylcarbamoylphenyl) disulfide and 200 ml. of well dried carbon tetrachloride in a 500 ml. round-bottom, short-neck flask was introduced chlorine gas, giving a homegeneous solution.

After further introduction of chlorine gas for 30 minutes, the carbon tetrachloride was removed by evaporation under reduced pressure. The resulting residue was added to a mixture of 200 ml. of well dried chloroform and 55 g. of 1-(2,4,6-trichlorophenyl)-3-(2-chloro-5-N-dodecylcarbamoylanilino)-5-pyrazolone in a 500 ml. round-bottom, short-neck flask with stirring at a room temperature. The mixture was refluxed for 1 hour and the chloroform was removed by evaporation under reduced pressure. The residue was recrystallized from 50 ml. of ethyl acetate, giving 52 g. of 1-(2,4,6-trichlorophenyl)-3-(2-chloro-5-N-dodecylcarbamoylanilino)-4-(3-N-dodecylcarbamoylphenylthio)-5-pyrazolone.

The crystals thus obtained were dissolved in 150 ml. of chloroform, 50 ml. of acetonitrile and 6 g. of pyridine in a 500 ml. round-bottom, short-neck flask, and 7.5 g. of butanoic chloride was added dropwise with stirring. After completion of the addition, the mixture was kept stirred for additional 10 minutes at ambient temperature and the solvent was removed by evaporation under reduced pressure. The residue was dissolved in 150 ml. of ethyl acetate and 150 ml. of water, and the ethyl acetate layer was washed with water, dried and evaporated to dryness under reduced pressure. The resulting dry solid was recrystallized from 55 ml. of acetonitrile, affording 31 g. of the desired compound melting at 111°–113° C.

| | Elementary analysis (%): | | | | |
|---|---|---|---|---|---|
| | C | H | N | Cl | S |
| Calculated: | 61.87 | 7.03 | 7.07 | 14.33 | 3.24 |
| Found: | 61.84 | 7.12 | 7.01 | 14.25 | 3.14 |

PREPARATION 2

1-(2-chloro-4,6-dimethylphenyl)-3-[3-{α-(3-pentadecylphenoxy)butyrylamino}benzoylamino]-4-(3-myristoylamino) phenylthio-5-benzoyloxypyrazole (Illustrated compound No. 3)

Following substantially the same procedures as in Example 1 except that bis(3-myristoylaminophenyl) disulfide, 1-(2-chloro-4,6-dimethylphenyl)-3-[3-{α-(3-pentadecylphenoxy)butylamino}benzoylamino]-4-(3-myristoylamino)phenylthio-5-pyrazolone and propionyl chloride were used in place of bis(3-N-dodecylcarbamoylphenyl) disulfide, 1-(2,4,6-trichlorophenyl)-3-(2-chloro-5-N-dodecylcarbamoylanilino)-5-pyrazolone and butyryl chloride, respectively, there was obtained the desired compound melting at 121°–123° C. when recrystallized from n-hexane/alcohol. Yield; 64%.

| | Elementary analysis (%): | | | | |
|---|---|---|---|---|---|
| | C | H | N | Cl | S |
| Calculated: | 70.84 | 8.29 | 6.26 | 3.17 | 2.87 |
| Found: | 70.61 | 8.30 | 6.25 | 3.10 | 2.81 |

PREPARATION 3

1-(2,4,6-trichlorophenyl)-3-[2-chloro-5-(3-octadecenylsuccinimid-1-yl)anilino]-4-[4-(4-octylphenoxy)phenylthio]-5-valeryloxypyrazole (Illustrated compound No. 8)

Following substantially the same procedures as in Example 1 except that bis[4-(4-octylphenoxy)phenyl] disulfide, 1-(2,4,6-trichlorophenyl)-3-[2-chloro-5-(3-octadecenylsuccinimid-1-yl)anilino]-5-pyrazolone and valeryl chloride were used in place of bis(3-N-dodecylcarbamoylphenyl) disulfide, 1-(2,4,6-trichlorophenyl)-3-(2-chloro-5-N-dodecylcarbamoylanilino)-5-pyrazolone and butyryl chloride, respectively, there was obtained the desired compound melting at 108°-109° C. when recrystallized from acetonitrile. Yield; 58%.

| | Elementary analysis (%): | | | | |
|---|---|---|---|---|---|
| | C | H | N | Cl | S |
| Calculated: | 65.71 | 6.94 | 4.94 | 12.52 | 2.83 |
| Found: | 65.53 | 6.84 | 4.69 | 12.61 | 2.85 |

PREPARATION 4

1-(2,4,6-trichlorophenyl)-3-(2-chloro-5-dodecylcarbamoylanilino)-4-(3-dodecylcarbamoylphenylthio)-5-benzenesulfonyloxypyrazole (Illustrated compound No. 48)

Following the same procedures as in Example 1 except that 13 g. of benzenesulfonyl chloride were used in place of butyryl chloride, there was obtained the desired compound melting at 112°-114° C. in the form of white powdery crystals when recrystallized from hexane/alcohol. Yield; 61%.

| | Elementary analysis (%): | | | | |
|---|---|---|---|---|---|
| | C | H | N | Cl | S |
| Calculated: | 60.05 | 6.37 | 6.61 | 13.38 | 6.05 |
| Found: | 60.12 | 6.35 | 6.54 | 13.13 | 6.00 |

The addition of the compound of the invention into a silver halide emulsion may be achieved by dissolving the compound in a high boiling point solvent such as dibutyl phthalate, dioctyl phthalate, tricresyl phosphate, N,N-diethyldodecanamide and diethyllaurylamide and/or a low boiling point solvent such as ethyl acetate, butanol, chloroform, n-propyl acetate, methanol and acetone, and then by adding the resulting solution into the emulsion.

The amount of addition of the compound according to the invention may be usually 0.1-5.0 mM per $cm^2$ emulsion layer.

The addition of the compound of the invention may usually and preferably be performed after completion of chemical digestion.

The layer composition of light-sensitive multiple layers silver halide color photographic material of the invention may be usually in accordance with normal substractive color photography. In principle, the layer composition comprises three basic layers containing a yellow coupler to form a yellow dye in the blue sensitive-layer, a magenta coupler to form a magenta dye in the green-sensitive layer, for which coupler the compounds of the invention being advantageously used, and a cyan coupler to form a cyan dye in the red-sensitive layer, respectively. Various photographic characteristics, such as hue characteristics, color reproducibility and graininess of colored dye may be improved by using diverse kinds of various couplers having different characteristics each other and by forming multiple layers, such as double or triple layers on each layer or on the whole layers. Particularly, light-sensitive multiple layers silver halide color photographic materials having superior color density, linearity, graininess of colored dye, stability, fog property and color reproducibility may be obtained by using one or more of magenta couplers of the invention within the green-sensitive layer in the form of single or multiple layers.

Beside the above-mentioned basic layers, there may be optionally coated various layers for the purpose of protection, prevention of color stain, improvements in the graininess, color reproducibility and film coating.

The silver halide emulsion used for the light-sensitive silver halide color photographic material of the invention includes any of silver halides usually employed for conventional light-sensitive silver halide photographic materials, for instance, silver chloride, silver bromide, silver iodide, silver chlorobromide, silver iodobromide, silver chloroiodobromide, and the like. The silver halide may be contained, preferably in amount of from 0.1 to 0.5 mole per liter emulsion. The silver halide emulsion is prepared in a usual way.

As for binders for silver halides, there may be employed hydrophilic colloid material such as gelatin.

The light-sensitive silver halide color photographic material of the invention may be prepared by coating an emulsion on such a support that has a good planarity and shows less change in size during production and processing. The support includes plastic films, plastic laminated paper, baryta paper, synthetic paper and hard plates made of glass, metal and ceramics. More concretely, it includes films of cellulose acetate, cellulose nitrate, polyvinyl acetal, polypropylene, polyethylene terephthalate, polyamide, polycarbonate or polystyrene, and polyethylene laminated paper, polypropylene synthetic paper and baryta paper. The support may optionally be selected, depending on the purpose and use of light-sensitive silver halide color photographic material.

In general, the support is undercoated in order to reinforce the adhesion to the silver halide emulsion layer in a usual way.

After exposure of light-sensitive silver halide color photographic material of the invention, it may be processed according to usual color development to give a dye image. The fundamental processes of negative-to-positive method comprise color development, bleaching and fixing. The fundamental processes of reversal method comprise development with the first developing solution and white color exposure, or processing with a bath containing a fogging agent, and color development, bleaching and fixing.

The color developing agent used for processing of the light-sensitive silver halide color photographic material of the invention is an aqueous alkaline solution containing a developing agent and having pH value of above 8, preferably 9-12. Aromatic primary amine developing agent is meant to include compounds having primary amino group on the aromatic nucleus and having capability of developing the silver halide exposed, or precursors thereof capable of forming such compounds. As the developing agent, representative are p-phenylenediamine series compounds such as 4-amino- N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-N-β-methoxyethyl-4-amino-N,N-diethylaniline, 3-methoxy-4-amino-N-ethyl-N-β-hydroxyethylaniline, 3-methoxy-4-amino-N-ethyl-N-β-methoxyethylaniline, 3-acetamido-4-amino-N,N-diethylaniline, 4-amino-N,N-dimethylaniline, N-ethyl-N-β-[β-(methoxyethoxy)ethoxy]ethyl-3-methyl-4-aminoaniline and N-ethyl-N-β-(β-methoxyethoxy)ethyl-3-methyl-4-aminoaniline, or salts thereof such as sulfates, hydrochlorides, sulfites and p-toluenesulfonates.

The invention may be realized in various forms of light-sensitive silver halide color photographic materials.

According to an embodiment of the invention, a light-sensitive photographic material having a silver halide emulsion layer containing a diffusion-resistant coupler on a support is processed with an alkaline developer containing an aromatic primary amine series color developing agent to leave a water-insoluble or diffusion-resistant dye within the emulsion layer. According to another embodiment of the invention, a light-sensitive photographic material having a silver halide emulsion layer in combination with a diffusion-resistant coupler on a support is processed with an alkaline developer containing an aromatic primary amine series color developing agent to make it soluble in an aqueous medium and form a diffusible dye, and then, the dye is transferred into an image-receiving layer comprising another hydrophilic colloid, which process being called diffusion transfer color process.

The light-sensitive silver halide color photographic material of the invention includes every species of materials, for instance, color negative films, color positive films, color reversal films and color paper. The light-sensitive silver halide color photographic material of the invention may be applied to light-sensitive silver halide color photographic materials containing silver halide rather in small quantity, disclosed in German Offenlegungsschrift No. 23 57 964.

For instance, such materials containing silver halide in small quantity comprise from one to several ten percent of silver halide, as compared with ordinary light-sensitive silver halide color photographic materials, namely from about 65 to 375 mg. per $m^2$ of silver halide per layer in order to obtain the same density. The light-sensitive color photographic material containing silver halide in small quantity applicable to the present invention may be processed, e.g. in accordance with processes disclosed in U.S. Pat. Nos. 2,623,822 and 2,814,565 to give good results. Namely, the developed silver produced by color development in halogenation-bleached and again color developed to increase the dye amount formed. Alternatively, a method using a peroxide, or a method using a cobalt complex salt to utilize the color-enhancing activity may also be employed.

The invention is further concretely explained by the following working examples, by which the scope of embodiments of the invention may not be restricted.

EXAMPLE 1

20 g. of illustrated compound No. 7 were added to a mixture of 20 ml. of dibutyl phthalate and 40 ml. of butyl acetate and dissolved by heating them at 60° C. The resulting solution was mixed with 10 ml. of 10% aqueous solution of Alkanol B (alkylnaphthalenesulfonate, sold by Dupont Co.,) and 200 ml. of 5% aqueous solution of gelatin and emulsion dispersed with a colloid mill. The dispersion was added to 1 kg. of high sensitive silver iodobromide emulsion and coated on a film base and dried, giving a light-sensitive material [I]. Similarly, samples [II] to [VIII] according to the invention were prepared, using illustrated compounds Nos. (21), (22), (23), (1), (48), (49) and (24), respectively, in place of compound No. (7). Likewise, comparative samples [IX] to [XVIII] were prepared, using the under-mentioned comparative couplers (A) to (J), respectively, in place of compound No. 7. Each sample was wedge-exposed by an ordinary method and developed in accordance with a method described hereunder. Meanwhile, unexposed each sample was stored in an atmosphere containing 5 ml. of formalin in a 1000 $cm^3$ receptacle, and thereafter, exposed and developed in the similar way and the magenta color density was measured to determine the stability.

| Processing (at 38° C.): | Period: |
|---|---|
| color development | 3 min. 15 sec. |
| bleaching | 6 min. 30 sec. |
| washing | 3 min. 15 sec. |
| fixing | 6 min. 30 sec. |
| washing | 3 min. 15 sec. |
| stabilization | 1 min. 30 sec. |

Each processing solution had the following composition:

| | |
|---|---|
| Color developer: | |
| 4-amino-3-methyl-N-ethyl-N-(β-hydroxyethyl)-aniline sulfate | 4.75 g. |
| anhydrous sodium sulfite | 4.25 g. |
| hydroxylamine ½ sulfate | 2.0 g. |
| anhydrous potassium carbonate | 37.5 g. |
| sodium bromide | 1.3 g. |
| trisodium nitrilotriacetate monohydrate | 2.5 g. |
| potassium hydroxide | 1.0 g. |
| water | to make 1 liter |
| (adjusted to pH = 10.0 with potassium hydroxide). | |
| Bleaching solution: | |
| (ethylenediaminetetraacetato) ferric ammonium salt | 100.0 g. |
| (ethylenediaminetetraacetato) diammonium salt | 10.0 g. |
| ammonium bromide | 150.0 g. |
| glacial acetic acid | 10.0 ml. |
| water | to make 1 liter |
| (adjusted to pH = 6.0 with aqueous ammonia) | |
| Fixing solution: | |
| ammonium thiosulfate (50% aqueous solution) | 162 ml. |
| anhydrous sodium sulfite | 12.4 g. |
| water | to make 1 liter |
| (adjusted to pH = 6.5 with acetic acid) | |
| Stabilizing solution: | |
| formalin (37% aqueous solution) | 5.0 ml. |
| Konidax (sold by Konishiroku Photo Ind.) | 7.5 ml. |
| water | to make 1 liter |

The development was performed under the above-mentioned conditions.

Magenta color images thus obtained were measured with a densitometer (type PD-7R; sold by Konishiroku Photo Ind.) to determine the relative color density (S), fog (Fog), maximum density (Dmax), stability with formalin treatment $$(\text{stability } (\%) = \frac{\text{density with formalin treatment}}{\text{density without treatment}} \times 100),$$

solubility of coupler in high boiling point solvent and graininess and light stability of colored image.

The graininess (RMS) is indicated as 1000 fold value of standard deviation of the density variation occured when scanned with a microdensitometer having 25μ round shaped scanning aperture. The light sensitivity is indicated as the percent density against 1.0 of untreated concentration when irradiated with a Xenon fademeter for 16 hours. The DIR property is determined for the silver developing property.

Namely, the silver developing property is indicated as percent sample density added a coupler given the same exposure, against 1.0 of color developed silver density added no coupler. The higher value shows less development-inhibiting activity. The precipitating property is determined as follows. 1 g of coupler is dissolved in a high boiling point solvent (HBS) consisting of 1 g. of dibutyl phthalate and 1 g. of ethyl acetate at 60° C. and allowed to stand at room temperature (25° C.) and the precipitation of coupler crystals is visually observed. As comparative couplers, the following compounds (A) to (J) were used.

The results are shown in Table 1.

Comparative coupler (A)

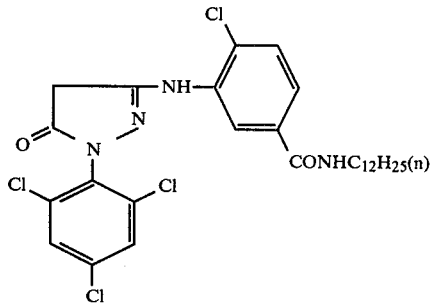

Comparative coupler (B)

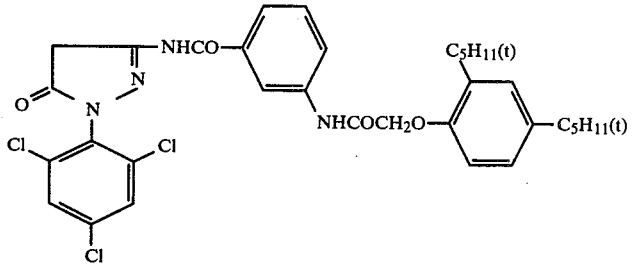

Comparative coupler (C)

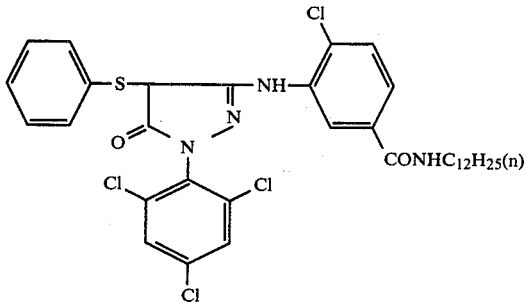

Comparative coupler (D)

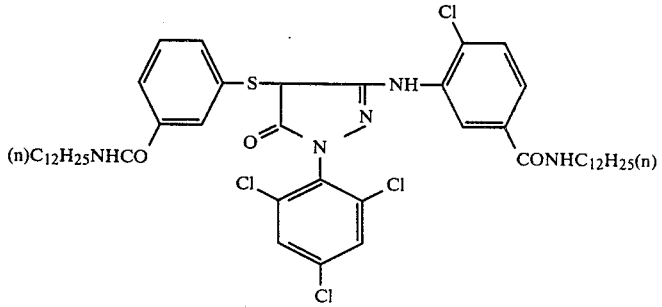

Comparative coupler (E)

-continued
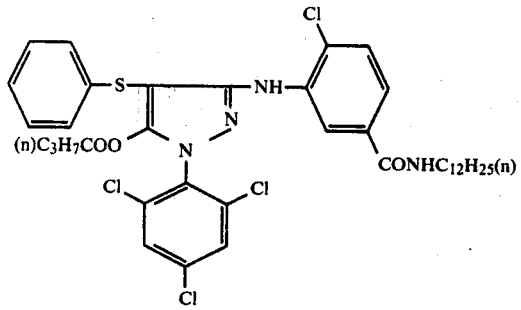
Comparative coupler (F)
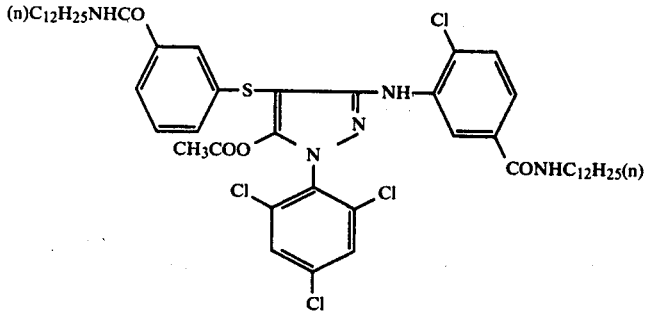
Comparative coupler (G)
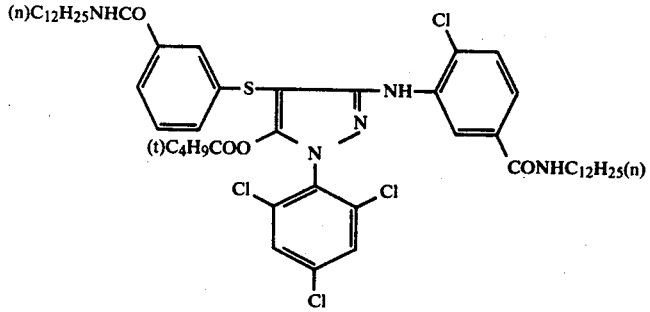
Comparative coupler (H)
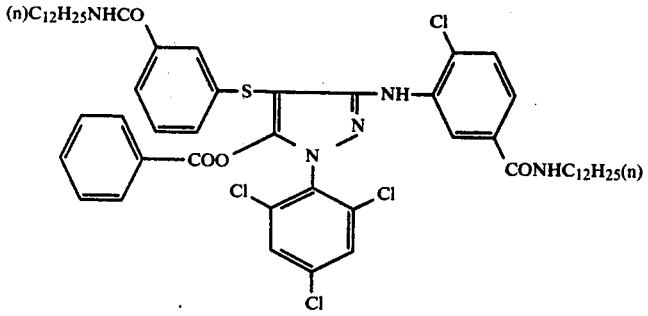
Comparative coupler (I)
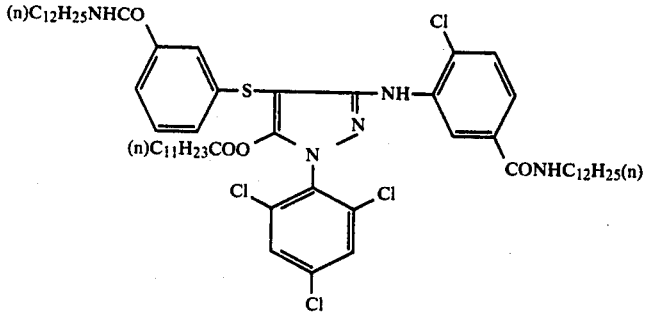
Comparative coupler (J)

-continued

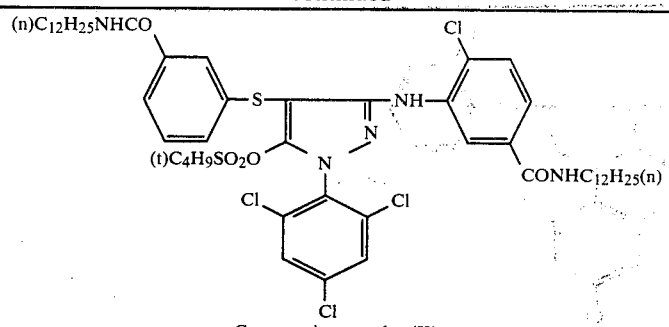

Comparative coupler (K)

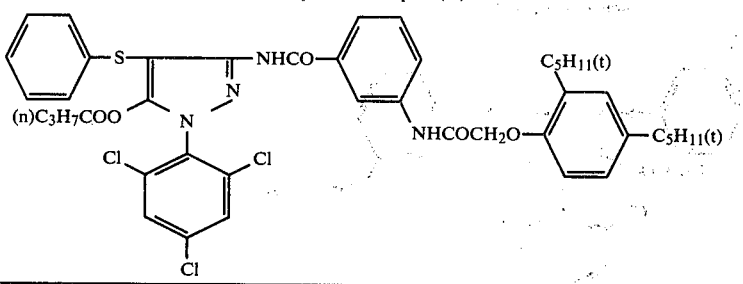

| Sample | Coupler | precipitating property | Stability against formalin (%) | Silver developing property (DIR property) | S | Fog | $D_{max}$ | Colored dye image: Light stability (retention rate % of colored dye) | Colored dye image: Graininess |
|---|---|---|---|---|---|---|---|---|---|
| [I] | illustrated compound No. 7 | none | 97 | 100 | 205 | 0.13 | 3.26 | 85 | 48 |
| [II] | illustrated compound No. 21 | " | 96 | 99 | 201 | 0.13 | 3.21 | 84 | 48 |
| [III] | illustrated compound No. 22 | " | 95 | 99 | 199 | 0.13 | 3.18 | 86 | 49 |
| [IV] | illustrated compound No. 23 | " | 96 | 100 | 200 | 0.13 | 3.20 | 84 | 50 |
| [V] | illustrated compound No. 1 | " | 97 | 99 | 195 | 0.12 | 2.37 | 80 | 46 |
| [VI] | illustrated compound No. 47 | " | 96 | 99 | 197 | 0.13 | 3.19 | 83 | 49 |
| [VII] | illustrated compound No. 48 | " | 95 | 99 | 196 | 0.13 | 3.15 | 83 | 48 |
| [VIII] | illustrated compound No. 24 | " | 96 | 99 | 200 | 0.13 | 3.19 | 84 | 48 |
| [IX] | comparative coupler (A) | " | 53 | 99 | 122 | 0.13 | 2.25 | 95 | 79 |
| [X] | comparative coupler (B) | " | 54 | 99 | 100 | 0.12 | 1.80 | 80 | 77 |
| [XI] | comparative coupler (C) | observed | 85 | 65 | 94 | 0.10 | 1.78 | 70 | 48 |
| [XII] | comparative coupler (D) | " | 86 | 82 | 146 | 0.24 | 2.55 | 70 | 75 |
| [XIII] | comparative coupler (E) | none | 88 | 75 | 98 | 0.10 | 1.99 | 79 | 49 |
| [XIV] | comparative coupler (F) | " | 87 | 98 | 152 | 0.19 | 2.50 | 75 | 63 |
| [XV] | comparative coupler (G) | " | 88 | 97 | 142 | 0.15 | 2.01 | 82 | 59 |
| [XVI] | comparative coupler (H) | " | 88 | 98 | 141 | 0.15 | 2.00 | 81 | 61 |
| [XVII] | comparative coupler (I) | " | 88 | 97 | 161 | 0.14 | 2.52 | 82 | 60 |
| [XVIII] | comparative coupler (J) | " | 87 | 97 | 140 | 0.15 | 2.58 | 81 | 62 |

As clearly shown in Table 1, the compounds of the invention have advantages such as very superior color properties, less fog, better stability against formalin, less precipitation of coupler crystals, and superior graininess and light stability of colored dye after development, over the comparative couplers.

EXAMPLE 2

High sensitive multiple layers light-sensitive color negative materials [XIX], [XX] and [XXI] having the following compositions were prepared on transparent polyethylene terephthalate film supports:

first layer, halation-preventing layer: a gelatin layer comprising black colloidal silver, dry thickness 1μ, second layer, intermediate layer: a gelatin layer comprising 2,5-di-t-octylhydroquinone, dry thickness 1μ, Third layer, red-sensitive emulsion layer: a red-sensitive silver iodobromide emulsion layer comprising $6.8\times10^{-2}$ mol. 1-hydroxy-N-[δ-(2,4-di-t-amylphenoxy)butyl]-2-naphthamide as the cyan coupler, $1.7\times10^{-2}$ mol. 1-hydroxy-N-[δ-(2,4-di-t-amylphenoxy)butyl]-4-(2-ethoxycarbonylphenylazo)-2-naphthamide as the colored coupler, and $4\times10^{-3}$ mol. 2-(1-phenyl-5-tetrazolylthio)-4-(2,4-di-t-amylphenoxyacetamido)-1-indanone as the DIR substance, respectively, per mol. silver halide (8 mol. % silver iodobromide and 92 mol. % silver bromide; coated silver amount, 3.5 g./m.$^2$, dry thickness 6μ, Fourth layer, intermediate layer: identical with the second layer, Fifth and sixth layers, green-sensitive layer: Each of fifth and sixth layers consists of green-sensitive silver halide emulsion layer containing couplers and DIR substance indicated in the following table. Namely, first green-sensitive, low sensitive silver iodobromide emulsion layer used for the fifth layer comprises 8 mol. % silver iodide and 92 mol. % silver bromide (coated silver amount, 1 g/m.$^2$) having dry thickness 3.5μ; and second green-sensitive, high sensitive silver iodobromide emulsion layer comprises 6 mol. silver iodide and 92 mol. % silver bromide (coated silver amount, 1.2 g./m.$^2$) having dry thickness 2.5μ. The fifth and sixth layers contain a coupler, a colored coupler and a DIR substance in such amounts as indicated in the following table.

| | Sample | (unit: mol.) [XIX] | [XX] | [XXI] |
|---|---|---|---|---|
| Fifth layer | coupler | $5.8\times10^{-2}$ | $5.8\times10^{-2}$ | $5.8\times10^{-2}$ |
| | colored coupler | $1.7\times10^{-2}$ | $1.7\times10^{-2}$ | $1.7\times10^{-2}$ |
| | DIR substance | $7\times10^{-2}$ | $7\times10^{-2}$ | $7\times10^{-2}$ |
| Sixth layer | coupler | illustrated compound No. 3 $1.1\times10^{-2}$ | illustrated compound No. 10 $1.1\times10^{-2}$ | comparative coupler (K) $1.1\times10^{-2}$ |
| | colored coupler | $5\times10^{-2}$ | $5\times10^{-2}$ | $5\times10^{-2}$ |
| | DIR substance | $2\times10^{-2}$ | $2\times10^{-2}$ | $2\times10^{-2}$ |

In the above table, the colored coupler, the DIR substance and the coupler in the fifth layer used are as follows:

coupler: 1-(2,4,6-trichlorophenyl)-3-[3-(2,4-di-t-amylphenoxy)acetamido]benzamido-5-pyrazolone colored coupler: 1-(2,4,6-trichlorophenyl)-3-(2-chloro-5-octadecenylsuccinimidoanilido)-4-(4-hydroxyphenylazo)-5-oxo-2-pyrazolone DIR substance: 2-(1-phenyl-5-tetrazolylthio)-4-(2,4,di-t-amylphenoxyacetamido)-1-indanone, Seventh layer, intermediate layer: identical with the second layer, Eighth layer, yellow filter layer: a gelatin layer comprising yellow colloidal silver and 2,5-di-t-ocytlhydroquinone, dry thickness 1μ

Ninth layer, blue-sensitive emulsion layer: a blue-sensitive silver iodobromide emulsion layer comprising $2.5\times10^{-1}$ mol. α-pivalyl-α-(3,5-dioxo-1,2-diphenylimidazolidin-4-yl)-2-chloro-5-[γ-(2,4-di-t-amylphenoxy)butylamido]acetanilide as the yellow coupler, and $5\times10^{-3}$ mol. ω-bromo-ω-(1-phenyl-5-tetrazolylthio)-4-lauroylamidoacetophenone as the DIR substance, respectively, per mol. silver halide (7 mol. % silver iodide and 93 mol. % silver bromide; coated silver amount, 1.2 g./m.$^2$, dry thickness 7μ), Tenth layer, protective layer: a gelatin layer, dry thickness 1μ.

Each sample was green light-exposed in the similar manner as in Example 1 and developed by the following processes:

| Process (at 38° C.): | period: |
|---|---|
| color development | 3 min. 15 sec. |
| bleaching | 6 min. 30 sec. |
| washing | 3 min. 15 sec. |
| fixing | 6 min. 30 sec. |
| washing | 3 min. 15 sec. |
| stabilization | 1 min. 30 sec. |

Each processing solution had the following composition:

| | |
|---|---|
| Color developer: | |
| 4-amino-3-methyl-N-ethyl-N-(β-hydroxyethyl)-aniline hydrochloride | 4.75 g. |
| anhydrous sodium sulfite | 4.25 g. |
| hydroxylamine ½ sulfate | 2.0 g. |
| anhydrous potassium carbonate | 37.5 g. |
| sodium bromide | 1.3 g. |
| trisodium nitrilotriacetate monohydrate | 2.5 g. |
| potassium hydroxide | 1.0 g. |
| water | to make 1 liter |
| (adjusted to pH = 10.0 with potassium hydroxide), | |
| Bleaching solution: | |
| (ethylenediaminetetraacetato) | |
| ferric ammonium salt (ethylenediaminetetraacetato) | 100.0 g. |
| diammonium salt | 10.0 g. |
| ammonium bromide | 150.0 g. |
| glacial acetic acid | 10.0 ml. |
| water | to made 1 liter |
| (adjusted to pH = 6.0 with aqueous ammonia), | |
| Fixing solution: | |
| ammonium thiosulfate (50% aqueous solution) | 162 ml. |
| anhydrous sodium sulfite | 12.4 g. |
| water | to make 1 liter |
| (adjusted to pH = 6.5 with acetic acid), | |
| Stabilizing solution: | |
| formalin (37% aqueous solution) | 5.0 ml. |
| Konidax (sold by Konishiroku Photo Ind.) | 7.5 ml. |

-continued

| | |
|---|---|
| water | to make 1 liter. |

The development was performed under the above-mentioned conditions.

The samples thus obtained were subjected to the density measurement through a green filter, in the similar manner as in Example 1, and the color density (S), fog (Fog) and maximum density ($D_{max}$) were calculated.

The results are shown in Table 2.

TABLE 2.

| Sample | S | Fog | $D_{max}$ |
|---|---|---|---|
| [XIX] | 127 | 0.13 | 2.40 |
| [XX] | 194 | 0.14 | 3.22 |
| [XXI] | 100 | 0.12 | 1.87 |

As shown in Table 2, the samples [XIX] and [XX] comprising the couplers of the invention show superior color properties as compared with the comparative sample [XXI] and are useful also as the multiple layers light-sensitive color photographic material.

EXAMPLE 3

A halation-preventing layer and a gelatin layer were coated on a triacetate film base, upon which a red-sensitive silver halide emulsion layer was coated such that the coated silver amount was 1700 mg./m$^2$. The silver halide emulsion layer contained conventional additives, such as sensitizing dye for imparting the red sensitivity, a hardner, a spreader and the like, and further 2-[α-(2,4-di-t-amylphenoxy)butylamido]-4,6-dichloro-5-methylphenol, as the cyan coupler, dissolved in a mixture of tricresyl phosphate and ethyl acetate and emulsion-dispersed with Alkanol B in amount of $1.3\times10^{-1}$ mol. per mol. silver halide. A gelatin layer was coated on the red-sensitive layer as the intermediate layer. On the layer, a green-sensitive silver halide emulsion layer was coated in amount of 1700 mg. of coated silver per m$^2$. The silver halide emulsion layer contained conventional additives, such as a sensitizing dye for imparting the green sensitivity, a hardner, a spreader and the like. Further, the illustrated compound No. 7, as the magenta coupler, dissolved in a mixture of tricresyl phosphate and ethyl acetate in amount of $1.0\times10^{-1}$ mol. per mol. silver halide was coated. After this, a gelatin layer was coated as the intermediate layer, upon which a blue-sensitive silver halide emulsion layer was coated in amount of 4300 mg. of coated silver per m$^2$. The silver halide emulsion layer contained conventional additives, such as a hardner, a spreader and the like, and α-pivalyl-α-(1-benzyl-2-phenyl-3,5-dioxoimidazolidin-4-yl)-2'-chloro-5'-[γ-(2,4-di-t-amylphenoxy)butynamido]acetanilide, as the yellow coupler, dissolved in a mixture of tricresyl phosphate and ethyl acetate and emulsion-dispersed with Alkanol B in amount of $2\times10^{-1}$ mol. per mol. silver halide.

Finally, a gelatin layer was provided as the protective layer, thus giving color reversal film samples.

The samples were wedge-exposed according to a usual method and processed by the following procedures with solutions having the following compositions:

| Process: | Period: | | Temperature: |
|---|---|---|---|
| first development | 3 min. | | 38° C. |
| first stopping | | 30 sec. | " |
| washing | 1 min. | | " |
| color development | 3 min. | 40 sec. | 43° C. |
| second stopping | | 30 sec. | 38° C. |
| washing | 1 min. | | " |
| bleaching | 6 min. | | " |
| fixing | 6 min. | | " |
| washing | 3 min. | | " |
| stabilization | | 50 sec. | " |

If necessary, pre-hardening and neutralization may be performed before first development.

| | |
|---|---|
| First developer: | |
| sodium polyphosphate | 2.0 g. |
| anhydrous sodium bisulfite | 8.0 g. |
| phenidone | 0.35 g. |
| sodium sulfite | 37.0 g. |
| hydroquinone | 5.5 g. |
| sodium carbonate | 33.0 g. |
| sodium thiocyanate (10% aqueous solution) | 13.8 ml. |
| sodium bromide | 1.3 g. |
| potassium iodide (0.1% aqueous solution) | 13.0 ml. |
| water | to make 1 liter |
| (pH = 9.9 ± 0.1), | |
| Color developer: | |
| sodium polyphosphate | 5.0 g. |
| benzyl alcohol | 4.5 g. |
| sodium sulfite | 7.5 g. |
| trisodium phosphate dodecahydrate | 31.0 g. |
| sodium bromide | 0.9 g. |
| potassium iodide (0.1% aqueous solution) | 90 ml. |
| sodium hydroxide | appropriate amount to adjust pH |
| 4-amino-N-ethyl-N-(β-methanesulfonamidoethyl)-n-toluidine sesquisulfate monohydrate | 11.0 g. |
| ethylenediamine | 3.0 g. |
| t-butylaminoboran hydride | 0.07 g. |
| water | to make 1 liter |
| (pH = 11.5 ± 0.1), | |
| Bleaching solution: | |
| (ethylenediaminetetraacetato)ferric ammonium salt | 170 g. |
| ammonium bromide | 300 g. |
| water | to make 1 liter |
| (pH = 5.8–6.0), | |
| Fixing solution: | |
| anhydrous sodium thiosulfate | 194.5 g. |
| anhydrous sodium bisulfite | 17.6 g. |
| anhydrous sodium hydrogenphosphate | 15.0 g. |
| water | to make 1 liter |
| (pH = 5.9 ± 0.2), | |
| Stabilizing solution: | |
| polyoxyethylene ether alcohol | 0.15 g. |
| formalin (37.5% aqueous solution) | 6.0 g. |
| water | to make 1 liter |

The results obtained by the procedures are shown in Table 3.

TABLE 3.

| Sample | Coupler | S | Fog | $D_{max}$ | Stability against formalin |
|---|---|---|---|---|---|
| [XXII] | illustrated compound No. 2 | 100 | 0.18 | 2.45 | 95 |
| [XXIII] | illustrated compound No. 6 | 154 | 0.20 | 3.37 | 96 |
| [XXIV] | illustrated compound No. 7 | 163 | 0.24 | 3.31 | 97 |

TABLE 3.-continued

| Sample | Coupler | S | Fog | $D_{max}$ | Stability against formalin |
|---|---|---|---|---|---|
| [XXV] | illustrated compound No. 11 | 157 | 0.21 | 3.28 | 97 |

As shown in Table 3, the samples of the invention give good color images and the magenta couplers of the invention are useful for the reversals.

Similar results could be obtained by using the illustrated compounds No. 2, 6 and 11 in place of No. 7.

EXAMPLE 4

Color print paper samples having the following layer constitution were prepared:

First layer: a blue-sensitive silver halide emulsion layer comprising an emulsion-dispersed two equivalents type yellow coupler in amount of 400 mg. of coated silver per $m^2$.

Constituents:

two equivalents type yellow coupler: α-pivalyl-α-(2,4-dioxo-1-benzylimidazolidin-3-yl)-2-chloro-5-[γ-(2,4-di-t-amylphenoxy)butyramido]acetanilide, $2\times10^{-1}$ *L mol. per mol. silver halide,* silver chloride: silver chloroiodobromide containing 1 mol. % silver iodide and 80 mol. % silver bromide, in amount of 1 mol. per 400 g. of gelatin, sensitizing dye:

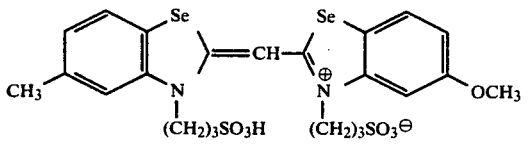

$2.5\times10^{-4}$ mol. per mol. silver halide,

Second layer: an intermediate layer consisting of gelatin, thickness μ,

Third layer: a green-sensitive silver halide emulsion layer comprising an emulsion dispersion listed in Table (a), in amount of 500 mg. of coated silver per $m^2$, Constituents:

silver halide: silver chlorobromide containing 80 mol. % silver bromide, 1 mol. per 500 g. of gelatin, sensitizing dye:

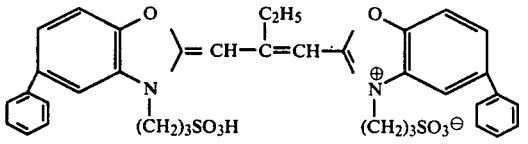

$2.5\times10^{-4}$ mol. per mol. silver halide,

TABLE (a):

| Emulsion dispersion | Amount |
|---|---|
| illustrated compound No. 7 | $2\times10^{-1}$ mol. per mol. silver halide |
| 2,2,4-trimethyl-6-hydroxy-7-t-octylcumarone | $1\times10^{-1}$ mol. per mol. silver halide |
| butyl phthalate | 134 ml. |
| ethyl acetate | 268 ml. |

Fourth layer: a gelatin layer comprising 2,5-di-t-octylhydroquinone (50 mg./$m^2$), 2-(benzotriazol-2-yl)-4,6-di-t-butylphenol (50 mg./$m^2$) and 2-(benzotriazol-2-yl)-4-t-butylphenol (50 mg./$m^2$), thickness 2μ, Fifth layer: a red-sensitive silver halide emulsion layer comprising an emulsion-dispersed two equivalents type cyan coupler, in amount of 500 mg. of coated silver per $m^2$, Constituents:

two equivalents type cyan coupler: 2-[α-(2,4-di-t-amylphenoxy)butyramido]-4,6-dichloro-5-methylphenol, $2\times10^{-1}$ mol. per mol. silver halide, sensitizing dye:

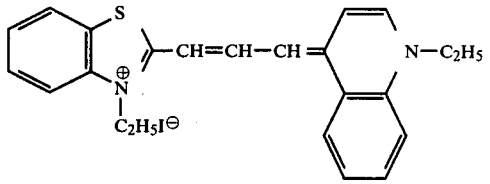

$2.5\times10^{-4}$ mol. per mol. silver halide, silver halide: silver chlorobromide containing 80 mol. % silver bromide, 1 mol. per 500 g. of gelatin, Sixth layer: a protective layer consisting of gelatin, thickness 1μ.

The silver halide emulsions used for the first, third and fifth layers were prepared according to the method disclosed in Japanese Patent Publication Specification No. 46-7772. They were sensitized chemically with sodium thiosulfate pentahydrate and contained sodium 4-hydroxy-6-methyl-1,3,3*a*,7-tetraazaindene as the stabilizer, bis(vinylsulfonylmethyl) ether as the hardner, and saponin as the coating aid.

Each color printing paper thus obtained was wedge-exposed through bluish green and red filters as mentioned above, giving yellow, magenta and cyan color images.

| Color developing process (at 31° C.): | Period: |
|---|---|
| color development | 3 min. |
| bleach-fixing | 1 min. |
| washing | 2 min. |
| stabilization | 1 min. |
| washing | 10 min. |
| drying (at below 95° C.) | |

Each processing solution used in respsective steps had the following composition:

| | |
|---|---|
| Color developer: | |
| N-ethyl-N-β-methanesulfonamidoethyl-3-methyl-4-aminoaniline sulfate | 4.0 g. |
| hydroxylamine | 2.0 g. |
| potassium carbonate | 25.0 g. |
| sodium chloride | 0.1 g. |
| sodium bromide | 0.2 g. |
| anhydrous sodium sulfite | 2.0 g. |
| benzyl alcohol | 10.0 ml. |
| polyethylene glycol ($\bar{n}$ = 400) | 3.0 ml. |
| water | to make 1 liter |
| (adjusted to pH = 10.0 with sodium hydroxide), | |
| Bleach-fixing solution: | |
| (ethylenediaminetetraacetato) ferric sodium salt | 60.0 g. |
| ammonium thiosulfate | 100.0 g. |
| sodium bisulfite | 10.0 g |
| sodium metabisulfite | 3.0 g. |

-continued

| | |
|---|---|
| water | to make 1 liter |
| (adjusted to pH = 6.6 with aqueous ammonia), | |
| Stabilizing solution: | |
| succinic acid | 10.0 g. |
| formalin (37% aqueous solution) | 15.0 ml. |
| water | 800 ml. |
| (adjusted to pH = 3.9 with sodium acetate) | |
| water | to make 1 liter |

The results obtained by the above-mentioned processes are shown in Table 4.

TABLE 4

| Sample | Coupler | S | Fog | $D_{max}$ | Stability against formalin |
|---|---|---|---|---|---|
| [XXVI] | illustrated compound No. 7 | 100 | 0.11 | 3.28 | 98 |
| [XXVII] | illustrated compound No. 12 | 98 | 0.10 | 3.15 | 97 |
| [XXVIII] | illustrated compound No. 20 | 99 | 0.10 | 3.17 | 98 |

As shown in Table 4, color prints having good color properties and stability against formalin could be obtained by the invention.

Similar results were obtained by using the illustrated compounds No. 12 and 20 in place of the illustrated compound No. 7.

We claim:

1. A color photographic material comprising a light-sensitive silver halide emulsion layer coated on a support containing a magenta coupler represented by general formula (I) or (II):

wherein $R_1$ represents a hydrogen atom, an alkyl, aryl or 5 or 6-membered heterocyclic group, $R_2$ represents a hydrogen atom, an alkyl, aryl, 5 or 6-membered heterocyclic, amino, sulfamoyl or carbamoyl group, $R_3$ represents an alkyl, aryl or 5 or 6-membered heterocyclic group having from 12 to 35 carbon atoms, $R_4$ represents a primary or secondary alkyl group having from 2 to 8 carbon atoms or a phenyl group, and $R_5$ represents a primary or secondary alkyl group having from 2 to 8 carbon atoms.

2. A color photographic material as claimed in claim 1 wherein $R_1$ represents an aryl group.

3. A color photographic material as claimed in claim 1 wherein $R_2$ represents an aryl amino carbonamide or ureide group.

4. A color photographic material as claimed in claim 3 wherein $R_2$ represents a phenyl amino group.

5. A color photographic material as claimed in claim 1, wherein, in formula [I], $R_4$ is ethyl group, n-propyl group, isopropyl group, n-butyl group, sec-butyl group or phenyl group.

6. A color photographic material as claimed in claim 1, wherein, in formula [II], $R_5$ is ethyl group, n-propyl group, isopropyl group, n-butyl group or sec-butyl group.

* * * * *

UNITED STATES PATENT AND TRADEMARK OFFICE

CERTIFICATE OF CORRECTION

PATENT NO. : 4,275,148

DATED : June 23, 1981

INVENTOR(S) : TAMOTSU KOJIMA et al

It is certified that error appears in the above—identified patent and that said Letters Patent is hereby corrected as shown below:

Column 48, line 5: After "(II):" insert the following formulas:

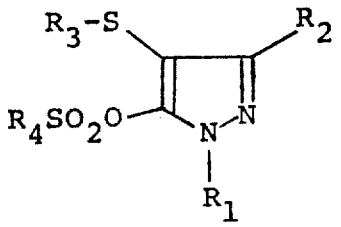

[I],

--

--.

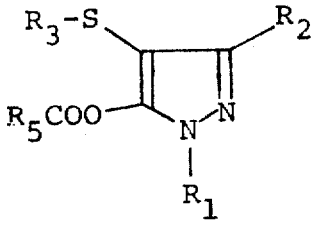

[II]

UNITED STATES PATENT AND TRADEMARK OFFICE

CERTIFICATE OF CORRECTION

PATENT NO. : 4,275,148

DATED : June 23, 1981

INVENTOR(S) : TAMOTSU KOJIMA et al

It is certified that error appears in the above—identified patent and that said Letters Patent is hereby corrected as shown below:

Column 46, line 50: Rewrite "respsective" as --respective--.

Signed and Sealed this

Sixth Day of April 1982

[SEAL]

Attest:

GERALD J. MOSSINGHOFF

Attesting Officer

Commissioner of Patents and Trademarks